US006115920A

United States Patent [19]

Shohara et al.

[11] Patent Number: 6,115,920

[45] Date of Patent: Sep. 12, 2000

[54] METHOD OF MANUFACTURING MULTI-GROOVED V PULLEY

[75] Inventors: Hiroshi Shohara; Mitsunori Adachi, both of Toyohashi; Haruo Suzuki, Aichi; Yasuji Kasuya, Okazaki, all of Japan

[73] Assignee: Denso Corporation, Kariya, Japan

[21] Appl. No.: 09/295,456

[22] Filed: Apr. 21, 1999

[51] Int. Cl.[7] ..... B21K 1/42

[52] U.S. Cl. ..... 29/892.3; 72/102; 474/170

[58] Field of Search ..... 29/892, 892.3, 29/893.32; 474/168, 170; 72/102

[56] References Cited

U.S. PATENT DOCUMENTS 4,767,387 8/1988 Matsuoka et al. .
4,874,353 10/1989 Matsuoka et al. .

FOREIGN PATENT DOCUMENTS 552 776 A1 7/1993 European Pat. Off. .
657 233 A1 6/1995 European Pat. Off. .
59-209445 11/1984 Japan .
60-216942 10/1985 Japan .

*Primary Examiner*—P. W. Echols
*Attorney, Agent, or Firm*—Pillsbury Madison & Sutro LLP

[57] ABSTRACT

In forming a multi-grooved V pulley by roll forming, a preliminary forming method is disclosed for preventing the occurrence of a top roll accompanied by a crack along each annular ridge of the pulley. A preliminary form roller is pressed against an annular material to fabricate a preliminary form having, in a sectional view, a corrugation including linear flat root portions and ridges alternating with them on the bottom surface of a wide annular groove. Next, a finish form roller having a plurality of annular V-shaped protrusions is pressed against the linear flat root portions of the preliminary form to thereby finish roll the preliminary form. The forward end of each V-shaped protrusion is kept off from the slopes of the corrugation ridges, and therefore is not broken under a bending moment.

3 Claims, 6 Drawing Sheets

METHOD OF MANUFACTURING MULTI-GROOVED V PULLEY

BACKGROUND OF THE INVENTION

1. Field of the Invention

The present invention relates to a method for manufacturing, by form rolling, a multi-grooved V pulley having a plurality of V grooves, for configuring a transmission unit with a poly V belt (multi-grooved V belt) having a plurality of V-shaped ridges, and a preliminary form roller used for the method.

2. Description of the Related Art

A conventional method of manufacturing a multi-grooved V pulley by form rolling will be explained with reference to FIGS. 1*a* to 1*c*. In a preliminary forming process, an annular material 1 having, in a sectional view a peripheral edge as shown in FIG. 1*a*, is held in a rotary die having a plurality of parts in a forming apparatus not shown and is rotated at a predetermined rotational speed. At the same time, as shown in FIG. 1*b*, a first form roller 2 having a flat peripheral edge surface (having a linear outer peripheral surface in a sectional view) is pressed radially against a channel-shaped groove 3 in the peripheral edge of the material 1. By thus rotating the material 1 and the roller 2 together, the channel-shaped groove 3 is forced wide open to thereby fabricate an annular intermediate material 5 having a wide V groove 4 with a flat bottom (linear in a sectional view).

Then, in the finish form rolling process shown in FIG. 1*c*, a finish form roller 6 with a peripheral edge having a sectional shape similar to that of the surface of the poly V belt is pressed against the intermediate material 5, and by thus rotating the material and the roller together, a multi-grooved V pulley 8 is roll formed as a product having a plurality of V grooves 7 corresponding to a plurality of V-shaped protrusions 15 of the finish form roller 6.

In this finish form rolling process, the V-shaped protrusions 15 of the finish form roller 6 bite into the intermediate material 5 while rotating thereby to form a plurality of V grooves 7 of the multi-grooved V pulley 8. At the same time, a plurality of ridges 9 are formed. The manner in which each corrugation ridge 9 is formed on the intermediate material 5 is shown sequentially in FIG. 2.

First, in stage a, the intermediate material 5 held in a rotary die not shown is designated by 5*a*. The finish form roller 6 shown in FIG. 1*c* is pressed against the flat bottom surface of the wide V grooves 4, whereby the intermediate material 5*a* is deformed into a material 5*b* shown in stage b. The material 5*b* thus deformed develops annular recesses 10 at the portions pressed by the V-shaped protrusions 15 of the finish form roller 6. At the same time, annular bulges 11 are formed between the two adjoining recesses 10 by the flow of molecules of the metal material. The bulges 11, however, are not flat and the portions thereof near the recesses 10 are comparatively high. Thus, a depression 12 is formed between a pair of the recesses 10.

In stage c of FIG. 2 in which the finish form roller 6 shown in FIG. 1*c* further bites into the intermediate material 5*b*, a sharp annular edge 13 is formed at each of the two corners of the deformed intermediate material 5*c*. Each edge 13 has a hardness increased by work hardening of the metal, and depending on the material, the hardness may reach the order of HRB 93 for a steel material. In addition, the depression 12 becomes deeper.

When the finish form roller 6 further bites into the intermediate material 5*c* into stage d, the bulges 11 rise higher under the pressure exerted by the side surfaces of the V-shaped protrusions 15 of the finish form roller 6 into a shape almost identical with the shape of the V-shaped ridges 9 of the final multi-grooved V pulley 8. Although the depression 12 converges at the crests of the bulges 11, the left and right edges 13 are overlapped and remain unremoved as an annular crack 14. The defect like the annular crack 14 formed at the forward end of the crest of the V-shaped protrusion 9 is called a "top roll".

The left and right edges 13 which are overlapped and constitute the annular crack 14 as a top roll never completely coalesce with each other, if left as they are. Even in the final stage e, therefore, an irregular annular crack 14 remains at the forward end of the crest of the ridge 9 over the entire periphery of the multi-grooved V pulley 8. Therefore, the ridge line of the annular V-shaped protrusion 9 of the multi-grooved V pulley is not smooth but in a rough state. In addition, the hardness at the forward end of the crest is increased by the work hardening of the material. In the case where a transmission unit is configured by winding a poly V belt of rubber or like on the multi-grooved V pulley 8 thus fabricated, the poly V belt may be damaged by the crack 14 in the ridge line of the V-shaped protrusion 9 of the multi-grooved V pulley 8, thus shortening the life of the poly V belt. Further, the edges 13 of high hardness develop during the form rolling process as described above. Therefore, the side surfaces of the V-shaped protrusion 15 of the finish form roller 6 are cut off, and the period (service life) during which it can be used as a tool is shortened.

A method of manufacturing a multi-grooved v pulley conceived for solving the problem of the top roll is described in JP-A-60-216942. In this improved conventional method, as shown in FIGS. 3*a* to 3*c*, a preliminary form roller having, in a sectional view, a comparatively low corrugated peripheral edge not shown is pressed against the bottom surface of the channel-shaped groove 3 of the annular material 1 shown in FIG. 3*a* similar to the one shown in FIG. 1*a*. In this way, a preliminary form 17 is fabricated which has a plurality of comparatively low ridges 19 formed on the bottom of the wide V groove 16 as shown in FIG. 3*b*.

In the next step, the finish form roller not shown is pressed against the preliminary form 17, thereby roll forming the multi-grooved V pulley 18 as shown in FIG. 2(*c*). The finish form roller used in the process includes a plurality of V-shaped protrusions corresponding to a plurality of the V grooves 7 of the multi-grooved V pulley 18. The V-shaped protrusions have the same intervals as the wavelength of the corrugation of the preliminary form roller or the wavelength of the ridges 19 of the corrugation of the preliminary form 17, and are higher than the wave crest of the preliminary form roller.

According to the improved conventional method described above, the part of the bottom of the V groove 16 of the preliminary form 17 corresponding to the intermediate portion formed by the V-shaped protrusions of the finish form roller does not constitute a depression 12 as shown in FIGS. 2(*b*) or (*c*), but is preformed as corrugation ridges 19. When the preliminary form 17 of FIG. 3*b* is processed into the multi-grooved V pulley 18 of FIG. 3*c*, therefore, the forward end of the crest of each of the V-shaped ridges 20 is prevented from developing a top roll including the annular crack 14 as shown in FIG. 2.

SUMMARY OF THE INVENTION

Nevertheless, the improved conventional prior art described with reference to FIGS. 3*a* to 3*c* is not necessarily free of a problem. As shown in FIG. 4, the wavelength of the corrugation ridges 19 of the preliminary form 17 is substantially identical with the intervals of the adjoining V-shaped protrusions 22 of the finish form roller 21. Assume, however, that the preliminary form 17 is mounted so undesirably on the rotary die 23 that the preliminary form 17 and the finish form roller 21 are displaced from each other in the axial direction, for example. Then, in the finish form rolling process, the forward end of each of the V-shaped protrusions 22 of the finish form roller 21 cannot accurately enter the root between the corresponding adjoining ridges 19 of the preliminary form 17, and erroneously comes into contact with the portion other than the root such as the slopes of the ridges 19. Thus, a large bending moment is exerted on the annular V-shaped protrusions 22 of the finish form roller 21. As a result, it may happen that part of the V-shaped protrusion 22 is broken (lost) or only one side of the V-shaped protrusion 22 is worn, thereby making the whole finish form roller 21 inoperative at an early time.

Also, it is needless to say that the portions other than the root are roll formed, including the slopes of the ridges 19 of the preliminary form 17 with which the forward end of the annular V-shaped protrusions 22 of the finish form roller 21 comes into contact. Therefore, the multi-grooved pulley 18 that has been subjected to the finish form rolling process may fail to have an intended shape.

In order to avoid this problem, the improved conventional method described above requires an expensive measurement controller, which monitors the axial displacement between the preliminary form 17 and the finish form roller 21 and, when a displacement occurs, corrects it automatically. This results in an increased cost of the forming apparatus and the product.

To cope with the problems of the prior art described above, the object of the present invention is to provide a method of manufacturing a multi-grooved v pulley by form rolling further improved over the prior art described above and a preliminary form roller used for the method, in which the problem of the top roll occurring at the forward end of the crest of each V-shaped protrusion of the multi-grooved V pulley is obviated to thereby lengthen both the life of the finish form roller and the life of the poly V belt wound on the multi-grooved V pulley. At the same time, in the case where a measurement controller is not installed for automatically detecting and correcting the displacement between the preliminary form and the finish form roller, the displacement, if occurred, is prevented from damaging the finish form roller, and a multi-grooved V pulley of the intended shape can be formed without any problem.

As means for solving the problems mentioned above, according to this invention, there are provided a method of manufacturing a multi-grooved V pulley and a preliminary form roller, used for the manufacturing method, as described in each claim of the invention appended hereto.

A method for manufacturing a multi-grooved V pulley according to claim 1 comprises a preliminary forming step for forming, in a sectional view, a corrugation having linear flat root portions on the bottom of a wide annular groove on the outer periphery of an annular material, and a succeeding finish form rolling step for pressing a finish form roller having a plurality of annular V-shaped protrusions against the annular groove of the preliminary form for form rolling the material, wherein the V-shaped protrusions of the finish form roller are in contact with the flat portions in the roots of the corrugation of the preliminary form for roll forming the particular portions, and therefore even when an axial displacement occurs between the preliminary form and the finish form roller, the forward end of the V-shaped protrusions of the finish form roller is kept out of contact with the slope portions other than the flat portions of the corrugation of the preliminary form. As a result, the bending moment which otherwise might occur due to the uneven contact of the V-shaped protrusions is not generated, and therefore the finish form roller is not damaged.

Also, as in the improved conventional method described above, the ridge portion of the corrugation of the preliminary form is located between the two V-shaped protrusions of the finish form roller. When the finish form roller is pressed against the peripheral end portion of the preliminary form, therefore, the ridge portion of the waveform rises higher. Thus no depression occurs, and hardened sharp edges are not formed on the sides of the ridge portion. As a result, the finish form roller is not damaged by the edges which otherwise might be formed, and the problem of the top roll which develops a crack as a forming defect when the edges on both sides close to each other is also obviated. Thus, the multi-grooved V pulley is prevented from damaging the mating poly V belt, and the service life of the finish form roller and the poly V belt is lengthened.

In the manufacturing method according to claim 2 or 3, the axial length of each linear flat portion of the corrugation on the bottom surface of the annular groove of the preliminary form is specifically 0.3 to 1.2 mm or preferably 0.3 to 0.9 mm.

The preliminary form roller according to claim 4 has a corrugated peripheral edge portion having, in a sectional view, linear flat portions formed at the crest portion thereof, which is used in the preliminary forming step in the method of manufacturing the multi-grooved V pulley described above. When an annular material is roll formed by this preliminary form roller, the corrugation of the peripheral edge portion of the preliminary form roller is transferred to the peripheral edge portion of the material thereby to produce a preliminary form having a corrugation as described in claim 1 in the bottom surface of the wide annular groove. Also, in the preliminary form roller according to claim 5 or 6, the axial length of each linear flat portion is specifically 0.3 to 1.2 mm or preferably 0.3 mm to 0.9 mm.

Further, in the preliminary form roller according to claim 7, the apex angle of a pair of sides (slopes) of each ridge portion of the corrugation is an obtuse angle larger than 90°, and therefore the ridge portion of the preliminary form to which the corrugation is transferred also assumes an obtuse angle, thereby preventing the top roll from developing at the time of preliminary forming.

BRIEF DESCRIPTION OF THE DRAWINGS

The above and other objects, features and advantages will be made apparent by the detailed description taken in conjunction with the accompanying drawings, in which.

DESCRIPTION OF THE PREFERRED EMBODIMENTS

Figure 1A:
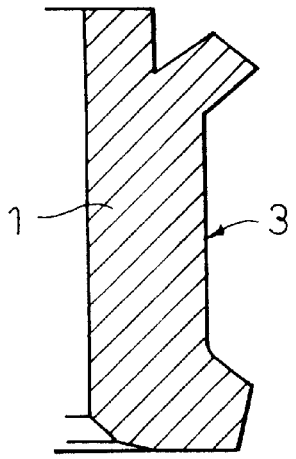
Fig.1a PRIOR ART
FIGS. 1*a* to 1*c* are sectional views for chronologically explaining a method of manufacturing a multi-grooved V pulley according to the prior art.
Figure 1B:
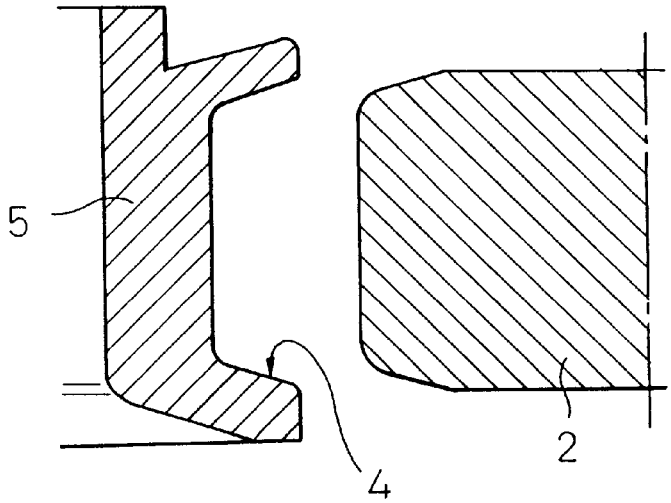
Fig.1b PRIOR ART
Figure 1C:
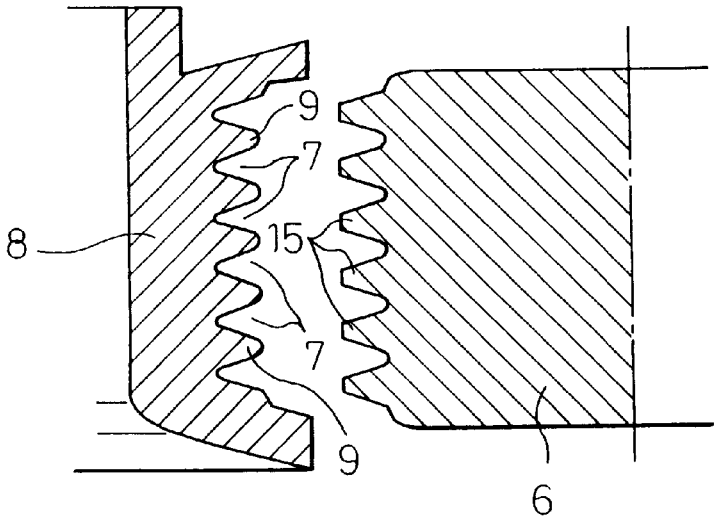
Fig.1c PRIOR ART
Figure 3A:
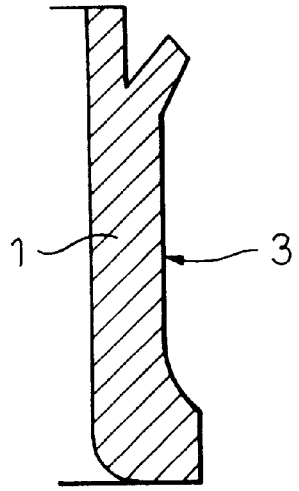
Fig.3a PRIOR ART
FIGS. 3*a* to 3*c* are sectional views showing the chronological changes of the shape of the material of a multi-grooved V pulley manufactured by an improved conventional method.
Figure 3B:
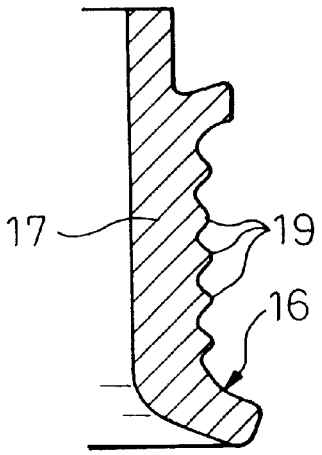
Fig.3b PRIOR ART
Figure 3C:
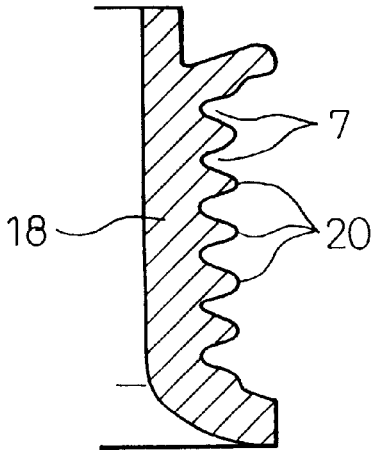
Fig.3c PRIOR ART

Also in the case where a multi-grooved V pulley is manufactured according to the method of the invention, the material first used in the preliminary forming process is, as in the conventional method, an annular material 1 having a channel-shaped groove 3 as shown in FIGS. 1*a* or 3*a*. In the improved conventional method described above with reference to FIGS. 3*a* to 3*c*, the first step in the preliminary forming process is to form by rolling a preliminary form 17 having corrugation ridges 19 as shown in FIG. 3*b*. This corrugation in the prior art is configured of only a curve completely free of linear flat portions in both the root and the crest.

Figure 5:
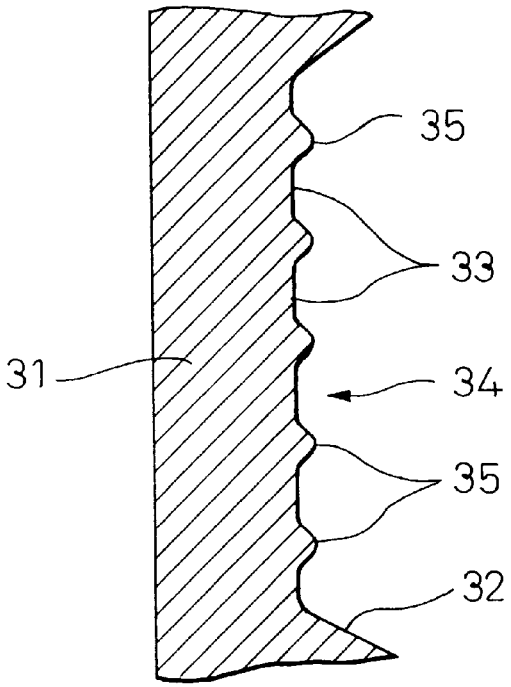
FIG. 5 is a partial sectional view showing the shape of the essential parts of a preliminary form obtained during the manufacturing process according to the method of the invention.

In the manufacturing method according to this invention, in contrast, though comprising a similar preliminary forming process, the shape of the preliminary form roller used therefor and the shape of the preliminary form produced thereby are both different from those of the prior art. Specifically, the feature of the invention lies in that, as shown in FIG. 5, the preliminary form 31 has a plurality of corrugation ridges 35 as viewed in the sectional shape on the bottom surface of a wide annular groove 32 and a unique corrugation 34 formed with linear flat portions 33 in the roots between the ridges 35. The axial length of each of the linear portions 33 can be 1 mm, for example. This value can alternatively be a larger 1.2 mm or a smaller 0.3 mm. The most preferable length is in the range of 0.3 to 0.9 mm. In this way, although the linear portions 33 represent a considerable proportion of the whole length in the axial direction, the alternate appearance of smooth corrugation ridges 35 between the linear portions 33 produces a corrugation 34 on the bottom surface of the wide annular groove 32.

Figure 2:
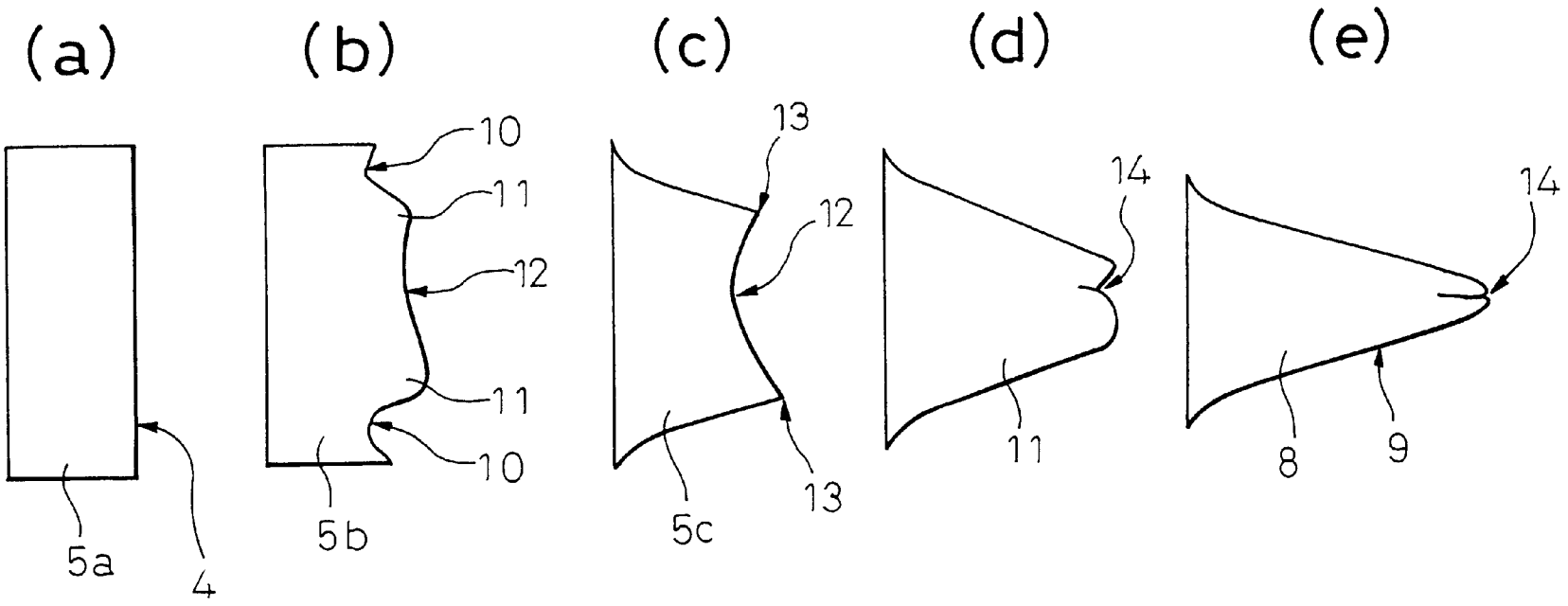
Fig. 2 PRIOR ART
FIG. 2 is a partial sectional view, showing stages a to e in which a material is roll formed, to explain the problem points of the prior art.
Figure 6:
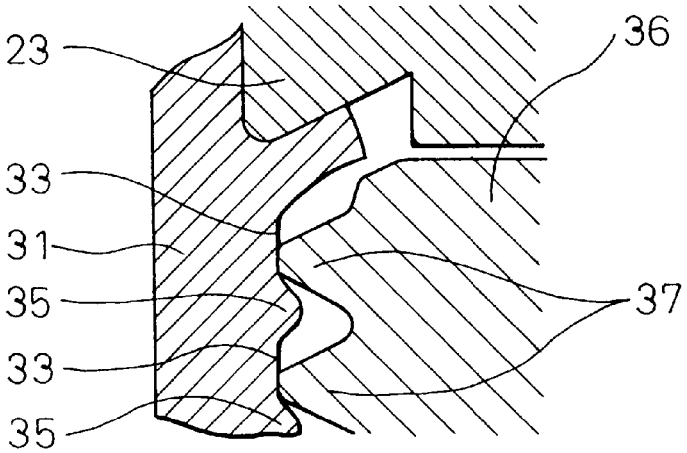
FIG. 6 is a partial sectional view for explaining the operation and effects of the invention.

The preliminary form 31 having a unique corrugated bottom surface of the wide annular groove 32 as shown in FIG. 5 is produced by the preliminary forming. After that, the preliminary form 31 is roll formed in the finish form rolling process by a finish form roller 36 as shown in FIG. 6. As in the prior art shown in FIGS. 3 and 4, the corrugation ridge 35 of the preliminary form 31 is located between two arbitrary annular V-shaped protrusions 37 of the finish form roller 36. This eliminates the concave depression 12 shown in FIGS. 2*b* and 2*c*. Thus the V-shaped ridges of the multi-grooved V pulley roll formed between the V-shaped protrusions 37 are prevented from developing a top roll having a crack 14 as shown in FIG. 2(*d*) or (*e*). The distance between adjoining V-shaped protrusions 36 of the finish form roller 36 is 3.56 mm, for example.

Figure 4:
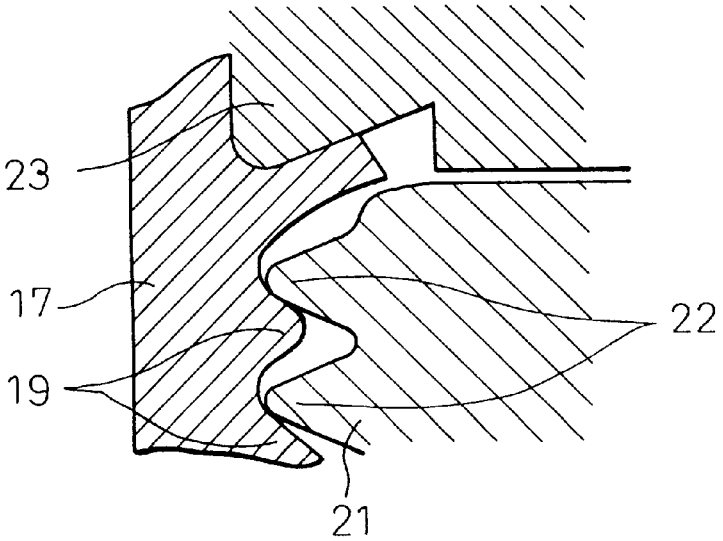
Fig.4 PRIOR ART
FIG. 4 is a partial sectional view for explaining the problem points of the improved conventional method.

As clear from FIG. 6, according to the invention, unlike in the prior art shown in FIGS. 3 and 4, the corrugation 34 produced in the preliminary form 31 in the preliminary forming process is formed with linear portions each having an axial length of about 0.3 to 0.9 to 1.2 mm. Even in the case where the preliminary form 31 mounted on the rotary die 23 is displaced in the axial direction, therefore, the forward ends of the V-shaped protrusions 37 of the finish form roller 36 can positively come into contact with the linear portions 33 and the V-shaped protrusions 37 are not brought into contact with the slopes of the ridges 35 of the preliminary form 31. The V-shaped protrusions 37, therefore, are not broken under a large bending moment nor are they unevenly worn. According to this invention, therefore, as compared with the prior art shown in FIGS. 3 and 4, the service life of the finish form roller 36 is lengthened.

Figure 7:
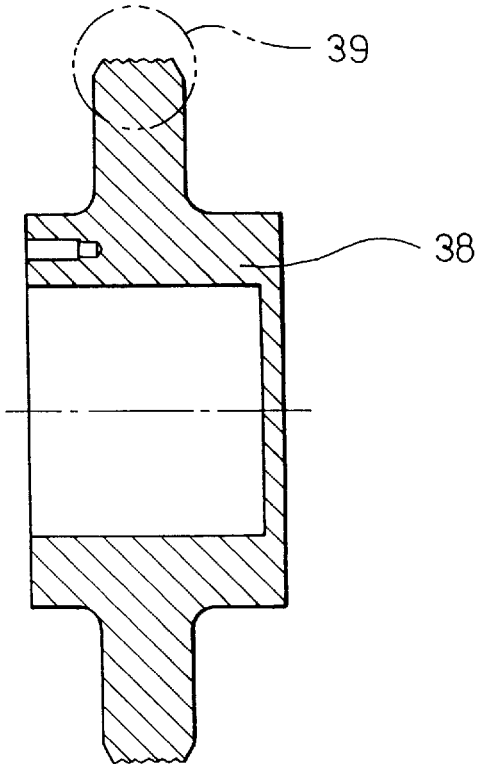
FIG. 7 is a sectional view of a preliminary form roller used in the manufacturing method according to this invention.
Figure 8:
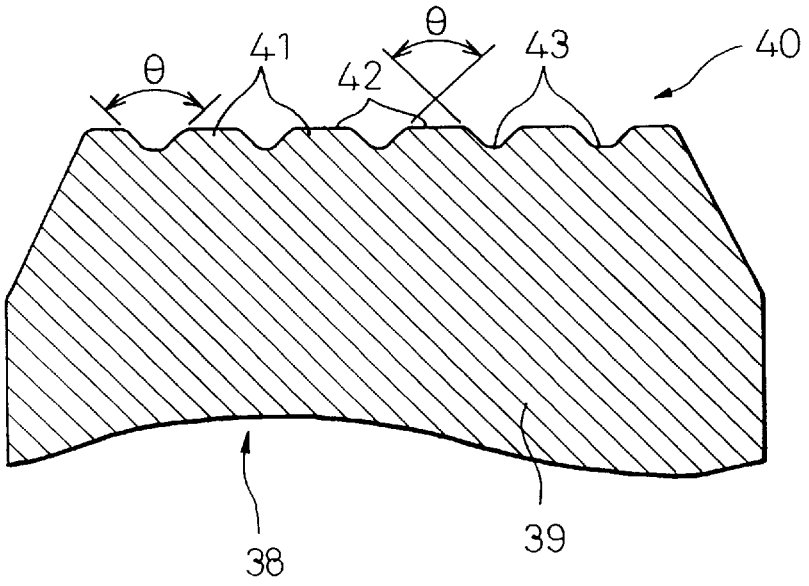
FIG. 8 is an enlarged sectional view showing the shape of the peripheral edge portion of the preliminary form roller shown in FIG. 7.

As described above, the feature of the invention lies in that the bottom surface of the wide annular groove 32 of the preliminary form 31 is formed with a unique corrugation 34 as shown in FIG. 5. A preliminary form roller 38 for roll forming the corrugation 34 on the preliminary form 31 is illustrated in FIG. 7, and an enlarged sectional view of the peripheral edge portion 39 thereof is shown in FIG. 8. The peripheral edge portion 39 of the preliminary form roller 38 is also formed with a corrugation 40 similar to the corrugation 34 of the preliminary form 31. In the preliminary form roller 38, however, a plurality of corrugation ridges 41 constituting the corrugation 40 each have a linear flat crest 42 as viewed in section. The apex angle θ (identical to the angle formed by the opposed side surfaces of the adjoining corrugation ridges 41) formed by a pair of sides (slopes) of the corrugation ridge 41 is assumed to be an obtuse angle larger than 90°.

In the preliminary forming process, the flat crest 42 of the preliminary form roller 38 is pressed against the material 1 as shown in FIG. 1*a* or 3*a* and thus the material 1 is roll formed, whereby the linear portions 33 of the corrugation 34 are formed in the preliminary form 31 shown in FIG. 5, as easily understood. A smooth curved recess 43 is formed between each two adjoining flat crests 42 of the preliminary form roller 38 for forming a corresponding corrugation ridge 35 in the preliminary form 31.

Figure 9A:
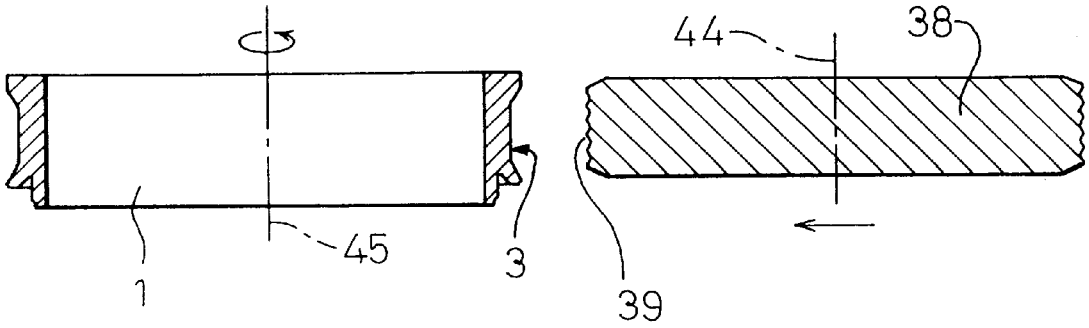
FIGS. 9*a* to 9*c* are sectional views for chronologically explaining the preliminary forming steps.
Figure 9B:
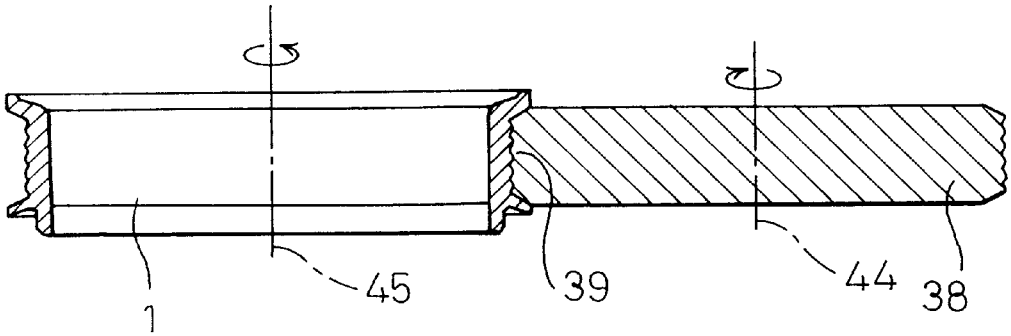
Figure 9C:
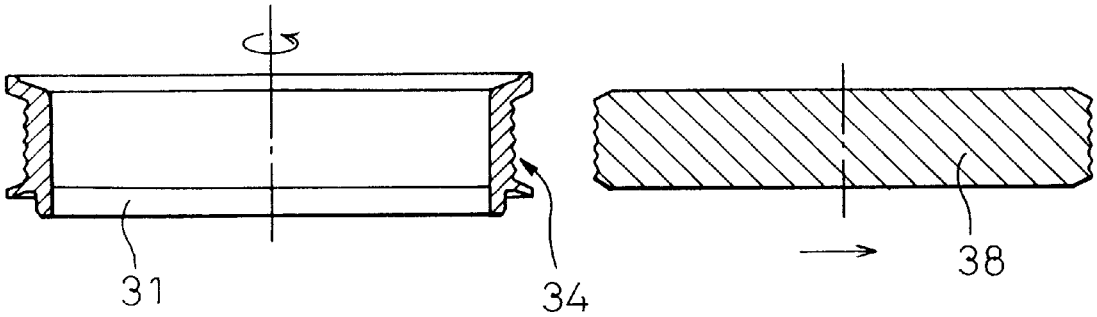

The preliminary forming steps with the preliminary form roller 38 are shown in chronological order in FIGS. 9*a* to 9*c*. In the forming apparatus, the rotary shaft 44 of the preliminary form roller 38 is supported in parallel to the rotary shaft 45 of a rotary die not shown supporting the annular material 1. The material 1 is rotated at the rate of 300 rpm, for example, together with the die, while the preliminary form roller 38 is moved in the direction of arrow in FIG. 9*a* and pressed against the channel-shaped groove 3 in the peripheral edge portion of the material 1.

As a result, as shown in FIG. 9*b*, the peripheral edge portion 39 of the preliminary form roller 38 bites into the channel-shaped groove 3 of the material 1 thereby to push the channel-shaped groove 3 wide open. At the same time, the corrugation 40 of the peripheral edge portion 39 of the preliminary form roller 38 is transferred to the bottom surface of the channel-shaped groove 3 of the material 1. In this way, a corrugation 34 having linear flat portions 33 and ridge portions 35 rising smoothly between the linear flat portions 33 is formed in the root of the channel-shaped groove 3, as shown in FIG. 5. By releasing the preliminary form roller 38 as shown in FIG. 9*c*, the preliminary forming process ends, and a preliminary form 31 is obtained. Then, in the finish form rolling process, the preliminary form 31 is roll formed by the finish form roller 36. In the process, the unique corrugation 34 of the preliminary form 31 has the effect of preventing the occurrence of a top roll, while at the same time lengthening the service life of the finish form roller 36 and the poly V belt.

In the case where the apex angle θ formed by a pair of the side surfaces of the corrugation ridge 41 of the preliminary form roller 38 shown in FIG. 8 is an acute angle, a top roll may occur also in the preliminary forming process. An obtuse angle θ, however, reduces the likelihood of a roll.

What is claimed is:

1. A method of manufacturing a multi-grooved V pulley comprising:

a preliminary forming step comprising the substeps of: rotating an annular material, and pressing a preliminary form roller against an outer peripheral surface of said material, whereby a corrugation having linear root portions and ridge portions each rising in a smooth curve between each corresponding adjoining two of the root portions is formed in a bottom surface of a wide annular groove of said annular material; and a finish form rolling step comprising the substeps of: rotating the preliminary form produced in said preliminary forming step, and pressing a finish form roller having a plurality of annular V-shaped protrusions arranged at intervals the same as a wavelength of said corrugation against the bottom surface of said preliminary form having said wide annular groove formed with said corrugation, whereby forward ends of the V-shaped protrusions of said finish form roller are brought into contact with the linear root portions of the corrugation formed in the preliminary form to roll form a multi-grooved pulley.

2. A method of manufacturing a multi-grooved V pulley according to claim 1, wherein each linear root portion of the corrugation formed in the bottom surface of the wide annular groove of the preliminary form has an axial length of not less than 0.3 mm and not more than 1.2 mm.

3. A method of manufacturing a multi-grooved V pulley according to claim 2, wherein each linear root portion of the corrugation formed in the bottom surface of the wide annular groove of the preliminary form has an axial length of not less than 0.3 mm and not more than 0.9 mm.

* * * * *

UNITED STATES PATENT AND TRADEMARK OFFICE

CERTIFICATE OF CORRECTION

PATENT NO. : 6,115,920
DATED : September 12, 2000
INVENTOR(S) : Shohara et al.

It is certified that error appears in the above-identified patent and that said Letters Patent is hereby corrected as shown below:

Title page,
Please add
- - [30] Foreign Application Priority Data
Apr. 28, 1998 [JP] Japan.....10-119370

Signed and Sealed this

Ninth Day of October, 2001

*Attest:*

Nicholas P. Godici

*Attesting Officer*

NICHOLAS P. GODICI
*Acting Director of the United States Patent and Trademark Office*